US010436511B2

(12) United States Patent
Hart

(10) Patent No.: US 10,436,511 B2
(45) Date of Patent: Oct. 8, 2019

(54) PULSED COMBUSTOR ASSEMBLY FOR DEHYDRATION AND/OR GRANULATION OF A WET FEEDSTOCK

(71) Applicant: HART ASSOCIÉS SARL, Urrugne (FR)

(72) Inventor: Oliver Hart, Urrugne (FR)

(73) Assignee: HART ASSOCIÉS SARL, Urrugne (FR)

( * ) Notice: Subject to any disclaimer, the term of this patent is extended or adjusted under 35 U.S.C. 154(b) by 0 days.

(21) Appl. No.: 15/736,096

(22) PCT Filed: Jun. 22, 2016

(86) PCT No.: PCT/EP2016/064351
§ 371 (c)(1),
(2) Date: Dec. 13, 2017

(87) PCT Pub. No.: WO2016/207185
PCT Pub. Date: Dec. 29, 2016

(65) Prior Publication Data

US 2018/0216885 A1 Aug. 2, 2018

(30) Foreign Application Priority Data

Jun. 24, 2015 (EP) ..... 15173569

(51) Int. Cl.
*F26B 23/02* (2006.01)
*F23C 15/00* (2006.01)
(Continued)

(52) U.S. Cl.
CPC ..... *F26B 23/026* (2013.01); *F23C 15/00* (2013.01); *F26B 11/22* (2013.01); *F26B 25/06* (2013.01); *F26B 25/12* (2013.01)

(58) Field of Classification Search
CPC .... F23C 15/00; F23C 2205/20; F26B 23/026; F24H 1/186; F28G 7/005
See application file for complete search history.

(56) References Cited

U.S. PATENT DOCUMENTS 2,945,459 A 7/1960 Junkermann
4,697,358 A * 10/1987 Kitchen ..... F26B 23/026 34/191
(Continued)

FOREIGN PATENT DOCUMENTS

CA 2639774 A1 1/2007
FR 2425618 A1 12/1979

OTHER PUBLICATIONS

International Search Report and Written Opinion of the ISA for PCT/EP2016/064351, ISA/EP, Rijswijk, NL, dated Sep. 14, 2016.
(Continued)

*Primary Examiner* — Gregory A Wilson
(74) *Attorney, Agent, or Firm* — Harness, Dickey & Pierce, P.L.C.

(57) ABSTRACT

The invention relates to a pulsed combustor assembly (A) for dehydration and/or granulation of a wet feedstock, in particular a viscous feedstock such as a feedstock containing natural fibers, sugars and/or vegetable starches, comprising a combustion chamber (16), at least one fuel supply line (23), at least one air supply line (26), and at least one pulsed air generator, wherein the pulsed air generator is connected to the air supply line (26) for generating at least a first pulsed air stream with a pulse frequency f1 entering the combustion chamber (16).

11 Claims, 1 Drawing Sheet

(51) Int. Cl.

| | |
|---|---|
| ***F26B 11/22*** | (2006.01) |
| ***F26B 25/06*** | (2006.01) |
| ***F26B 25/12*** | (2006.01) |

(56) References Cited

U.S. PATENT DOCUMENTS

| | | | | |
|---|---|---|---|---|
| 4,926,798 | A * | 5/1990 | Kardos | F23C 6/00 122/24 |
| 4,992,039 | A | 2/1991 | Lockwood, Jr. | |
| 5,205,728 | A * | 4/1993 | Mansour | F23C 6/047 110/212 |
| 5,209,821 | A * | 5/1993 | Shaw | A23L 2/10 127/61 |
| 5,556,274 | A * | 9/1996 | Ettie | F26B 3/12 34/372 |
| 5,881,475 | A * | 3/1999 | Kishimoto | C02F 1/048 34/381 |
| 7,531,014 | B2 * | 5/2009 | Chandran | B01J 8/40 422/139 |
| 2008/0264204 | A1 | 10/2008 | Larink | |
| 2009/0188789 | A1 | 7/2009 | Honecker et al. | |
| 2018/0058319 | A1 * | 3/2018 | Maqbool | F02C 5/10 |

OTHER PUBLICATIONS

Zhonghua: "Pulse Combustion Drying" In: "Handbook of Industrial Drying. Fourth Edition" Jul. 22, 2014 (Jul. 22, 2014).

* cited by examiner

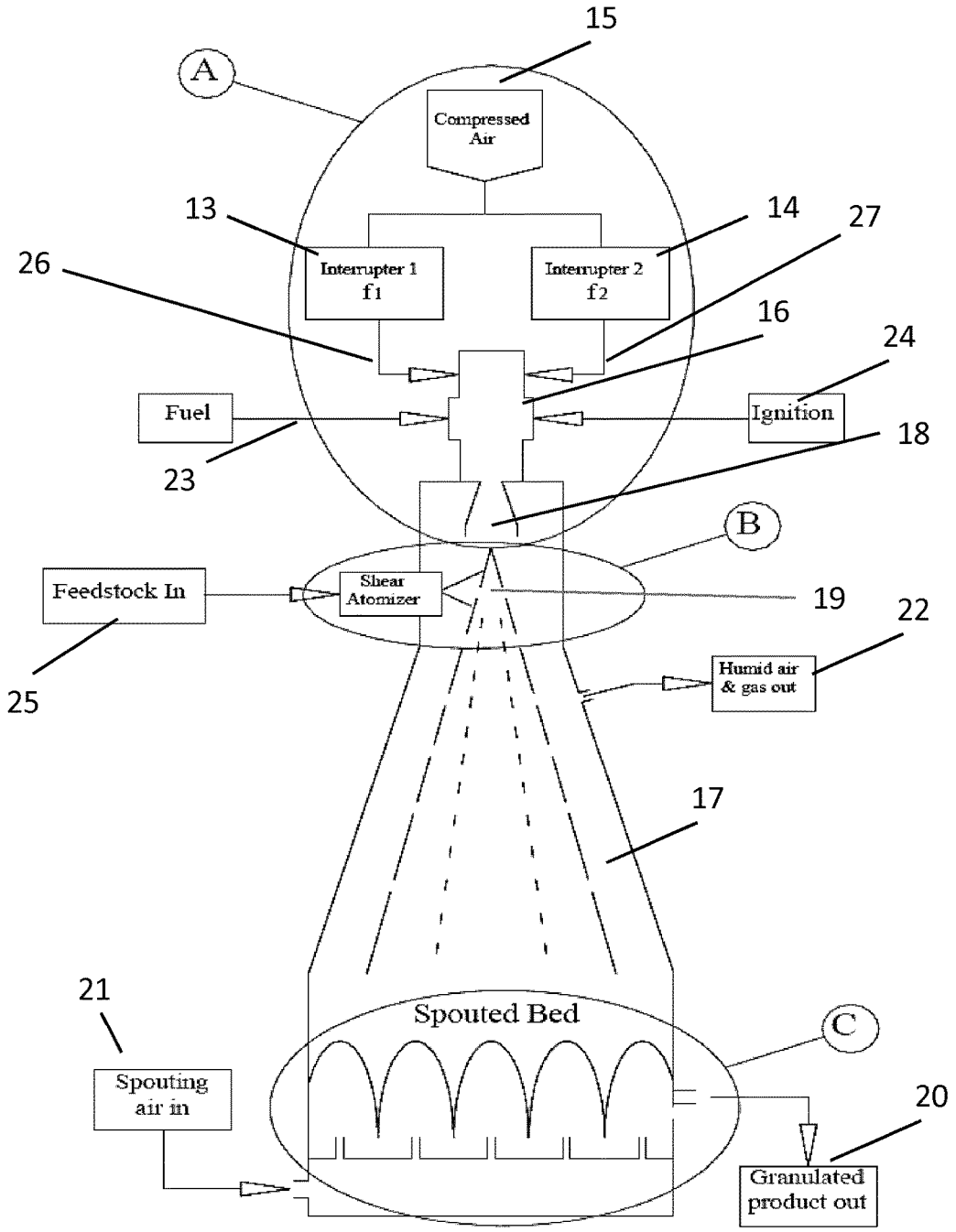
15
A
Compressed Air
13
14
27
26
Interrupter 1
f1
Interrupter 2
f2
16
24
Fuel
Ignition
18
23
B
Feedstock In
Shear Atomizer
19
22
25
Humid air & gas out
17
21
Spouted Bed
C
Spouting air in
20
Granulated product out

PULSED COMBUSTOR ASSEMBLY FOR DEHYDRATION AND/OR GRANULATION OF A WET FEEDSTOCK

CROSS-REFERENCE TO RELATED APPLICATIONS

This application is a 371 U.S. National Stage of International Application No. PCTEP2016/064351, filed Jun. 22, 2016. This application claims the benefit of and priority to European Patent Application No. 15173569.3, filed Jun. 24, 2015. The disclosures of the above applications are incorporated herein by reference.

The invention relates to a pulsed combustor assembly for dehydration and/or granulation of a wet feedstock, a pulsed combustion dryer for dehydration and/or granulation of a wet feedstock and a method for dehydration and/or granulation of a wet feedstock.

The term pulse, pulsed (or impulse) combustion (PC) originates from the intermittent (periodic) combustion of air (or another oxidant) with gaseous, liquid or solid fuel. Pulse combustors typically comprise inlet ports to admit combustion air and fuel, a combustion chamber in which the fuel/air mixture is ignited and a resonance tube or tailpipe used to expel the exhaust gases. The continuous stream of hot pulsating gases is then utilised in downstream processes such as heating, atomisation and drying of liquid feedstock.

Pulse combustion burners have advantages over steady flame combustion burners, e.g. an increased mass and heat transfer rate, an increased combustion intensity and higher energy efficiency with low excess air and reduced pollutant emissions. Disadvantages are a comparatively high noise level (requiring special attenuation measures) and difficulties of controlling (due to interactive process parameters).

In pulse combustion burners of the prior art, the "pulses" originate inside a combustion chamber at a predetermined frequency of oscillation which is dependent on the speed of sound and the physical relationship between the combustion chamber and tailpipe dimensions in accordance with the Helmholtz formulas. Known pulse combustors used in drying processes operate as Helmholtz resonators where the single (fixed) frequency originating from the combustion chamber is "tuned" primarily by changing the length of the tailpipe.

The mechanism used in such a pulse combustor to excite oscillations at a specific frequency (or "note") is similar to those used in music instruments such as a flute or by blowing air over the neck of an empty bottle. Here, the frequency of oscillation (or "note") originates inside the cavity of the instrument as a result of its size and shape. The music player blows an even (non-vibrating) air stream over an opening which excites secondary circulating currents or "eddies" which generate acoustic oscillations or "pulses".

It is an object of the present invention to propose a pulsed combustor assembly, a pulsed combustion drier and a method for dehydration and/or granulation, wherein a feedstock can be dried and/or granulated in an efficient way. In particular, drying and granulation shall be possible in a short time and/or with a comparatively small combustor assembly or combustion drier, respectively.

According to a first aspect of the invention, a pulsed combustor assembly for dehydration and/or granulation of a wet feedstock, in particular a viscous feedstock such as a feedstock containing natural fibres, sugars and/or vegetable starches, comprises a combustion chamber, at least one fuel supply line, at least one air supply line, and at least one pulsed air generator, wherein the pulsed air generator is connected to the air supply line for generating at least a first pulsed air stream with a pulse frequency f1 entering the combustion chamber.

A core idea of the present invention is the use of a pulsed air generator for providing a pulsed air stream. With the "pulsed" combustor method according to the invention, the combustion air is mechanically excited (or pulsed) at a predetermined frequency externally to and before entering the combustion chamber. A burner frequency therefore originates outside the combustion chamber and is not determined by the physical dimensions or operating conditions of either the combustion chamber or any tailpipe (as in the prior art). The source of oscillations produced by the pulsed combustor is similar to that of a trombone, bugle or a blowing horn (vuvuzela), where the "note" is dictated by the vibrating lips of the player and not by the natural resonance of a cavity. In such cases, the instrument body and its physical shape merely serve to amplify or intensify the acoustic note created by the player's lips. In the field of dehydration and/or granulation, the "pulsed" combustion method according to the present invention allows a simple adjustment of the air pulses, wherein it is not necessary to physically change any dimensions of the combustor or combustor tailpipe (as in the prior art). Hence, the pulsed combustor assembly contributes to an efficient and simple dehydration and/or granulation of wet feedstock.

The term "air" may be understood as ambient air but should be generally understood as being any gas (mixture) containing oxygen (of at least 5% or at least 20%). The term "beat frequency" (f3) may be understood as the audible beat frequency being the absolute value of the difference of the frequencies (f1, f2) generating the beat: $f3=|f1-f2|$. The pulsed air generator may be configured and connected so that a pulsed air stream is not immediately (i.e. directly at the outlet of the generator) mixed with the fuel (coming from the supply line). For example, a travel distance of the pulsed air before being mixed with the fuel to be combusted may be at least 1 cm, preferably at least 10 cm. Moreover, the pulsed air generator may be configured to actively generate the pulsed air stream, i.e. so that the frequency of the pulsed air stream is adjusted (controlled) by the pulsed air generator or, respectively, a control means of the pulsed air generator (only). This means, the pulsed air generator would not be a mere passive element which reacts on other conditions of the combustion assembly, such as a low pressure portion of a combustion cycle.

Preferably, the pulsed combustor assembly comprises a second air supply line and a second pulsed air generator being connected to the second air supply line and configured to generate a second pulsed air stream with a pulse frequency f2 entering the combustion chamber. The second air supply line and/or the second pulse air generator may be structured and/or configured and/or arranged similar to or identical to the first air supply line and/or first pulsed air generator, respectively. The frequency f2 is preferably higher or lower than f1. By this, the adjustment of the frequency within the combustion chamber is further improved. The frequency f1 and/or the frequency f2 may be adjustable. A control means may be provided for adjusting the frequency f1 within a predetermined range and/or for adjusting the frequency f2 within a predetermined range. "Adjusting the frequency" preferably means that a plurality of frequencies (larger than 0) can be set (the plurality of values may be a continuum or consist of discrete values). The control means can function as an open loop or closed loop control. A first control means may be provided for controlling f1. A second control means may be provided for controlling f2. One control means may be provided for controlling both f1 and f2. In any case, the adjustment possibilities are further improved so that the pulsed combustor assembly may contribute for a more efficient dehydration and/or granulation of a wet feedstock.

The first and/or second pulsed air generator may comprise an (in particular motorised) air interrupter. The air interrupter may comprise a rotating disk, lobe and/or valve assembly. Thereby, the pulse generation is executed in a simple way.

The first air supply line and the second air supply line may be connected to a common compressed air supply line (preferably being part of the pulsed combustor assembly). The pulsed combustor assembly may further comprise a source for compressed air.

Preferably, the frequencies f1 and f2 are adjusted (in particular by the control means) to generate a beat frequency f3 within the combustion chamber. In general, the frequencies f1 and f2 may have a similar (but not identical) value. For example, f2 may be at least 1% or at least 3% higher and/or less than 30% or less than 15% higher than the frequency f1. If there is only a small difference between the frequencies f1 and f2, a beat frequency f3 will be generated. A "beat" is an interference phenomenon between two waves (sounds) of slightly different frequencies. This interference results in a waveform comprising a high frequency component which is (at least approximately) the average frequency between f1 and f2 and a beat frequency which results from the envelope of the higher frequency component. The beat frequency is (at least approximately) the difference between the frequencies f1 and f2. Energy from the high-frequency components may be utilised both to atomise and dehydrate the wet feedstock passing through an impingement zone. On the other hand, the low beat frequency may pass through the combustion chamber and enhance the dehydration in a drying chamber arranged downstream. Thereby, the efficiency of the dehydration process is improved. In particular, the time for dehydration is reduced and a comparatively small drying chamber can be used.

Preferably, the control means is configured to simultaneously vary the frequencies f1 and f2 within a predetermined frequency range, wherein a difference f1−f2 is preferably at least substantially constant for generating an at least substantially constant beat frequency f3. The frequency range (within which f1 and f2 may be varied) can be for example 100 to 600 Hz, preferably 300 to 500 Hz. Thereby, a high band of frequencies may be generated containing both odd and even harmonics of an average frequency f4=(f1+f2)/2, while the low beat frequency f3 may preferably remain (effectively) unchanged (if f3 is constant). The difference f1−f2 can be between 10 Hz and 30 Hz, in particular 20 Hz. Advantageously, the average frequency f4 is adapted to current process parameters, in particular the temperature within the combustion chamber. Thereby, resonance conditions can be adjusted (which are dependent on the speed of sound being dependent on the temperature). Preferably, a temperature determining means is provide for determining the temperature within the combustion chamber. The control means may control f1 and f2 based on the temperature.

The compressed air (modulated by f1 and f2) may be mixed with fuel. The mixture may be ignited by an ignition source inside the combustion chamber.

In general, f1 and/or f2 may be more than 100 Hz, preferably more than 300 Hz and/or less than 600 Hz, preferably less than 500 Hz. An average frequency f4=(f1+f2)/2 may be more than 300 Hz and/or less than 500 Hz. The beat frequency f3 may be more than 10 Hz and/or less than 30 Hz.

The frequencies f1 and f2 are preferably adjusted (in particular by the control means) such that the fundamental frequency and/or odd and/or even harmonics of an average frequency f4=(f1+f2)/2 resonate with the combustion chamber. In particular, a high frequency band (with a fundamental frequency e.g. between 300 to 500 Hz) as defined by f1 and f2 may be adjusted to resonate with a comparatively small (regarding its volume or acoustical length, respectively) combustion chamber while the (low) beat frequency f3 (typically at least approximately 30 Hz) passes through the combustion chamber and resonates with a comparatively large (regarding its volume or acoustical length, respectively) drying chamber.

The pulsed combustion (continuous pulsed combustion) in the combustion chamber may generate a stream of high-temperature exhaust gases which exit at a high velocity (for example, 100 m/s) via a nozzle. The mass and inertia of the high-temperature, oscillating exhaust gas may form a conduit (waveguide) on which both a high and a low-frequency acoustic shockwave may be super-imposed. Such conduit may additionally channel acoustic energy at "screech" frequencies, as well as a broadband of harmonic frequencies generated inside the combustion chamber, towards an impingement zone.

The frequencies f1 and f2 may be adjusted (in particular by the control means) such that the combustion chamber functions as a low pass filter absorbing the average frequency f4=(f1+f2)/2, wherein the-beat frequency f3 passes preferably (substantially) unchanged. In particular, the average frequency stays within the combustion chamber. In particular, acoustic pulses at the beat frequency f3, generated in the combustion chamber, may be too low to excite acoustic resonance in the cavities of the (small volume) combustion chamber and pass through the combustion chamber (and preferably through a shear atomizer downstream of the combustion chamber) to find resonance in the (large volume) drying chamber. In general, the combustion chamber may behave like a low-pass filter for the beat frequency f3.

According to another aspect of the present invention, a pulsed combustion drier for dehydration and/or granulation of a wet feedstock, in particular viscous feedstock such as a feedstock containing natural fibres, sugars and/or vegetable starches, comprises a pulsed combustor assembly as described above.

The pulsed combustion drier may comprise an atomizer, in particular shear atomizer. The pulsed combustion drier may comprise a drying chamber. A volume of a drying chamber may be larger than a volume of the combustion chamber. Preferably, the volume of the drying chamber is at least 50 times, further preferably at least 100 times, even further preferably at least 300 times, e.g. 600 times as large the volume of the combustion chamber. The volume of the drying chamber may be less than 1000 times the volume of the combustion chamber, preferably less than 800 times, further preferably less than 600 times. An acoustic length of the drying chamber may be at least 5 times, further preferably at least 10 times, even further preferably at least 30 times as long as an acoustic length of the combustion chamber. The pulsed combustion drier may comprise a granulator, in particular spouted bed granulator. The resonance frequency of the combustion chamber may be at least 2 times, preferably at least 3 times, further preferably, at least 4 times, even further preferably at least 6 times as large as the resonance frequency of the drier. The granulator (spouted bed granulator) may comprise a free board area (=area between a top surface of a bed of the granulator and a nozzle where the feedstock emerges).

It is preferred that the beat frequency f3 resonates with the drying chamber. In general, it is possible to induce (or excite) acoustic resonance in both cavities (the combustion chamber and the drying chamber) even if they have two different sizes. This is achieved by "mixing" the frequencies f1 and f2 and generating the beat frequency f3. Thereby, it is possible not only to have acoustic pulses in the combustion chamber (as in principle also in the prior art) but at the same time, also in the (large volume) drying chamber. Thereby, the dehydration and/or granulation can be realised in a more efficient way, in particular faster.

According to another aspect of the invention, a method for dehydration and/or granulation of a wet feedstock, in particular a viscous feedstock such as a feedstock containing natural fibres, sugars and/or vegetable starches, preferably utilising the pulsed combustor assembly of the pre-described kind and/or the pulsed combustion drier of the pre-described kind, comprises a supply of fuel via a fuel supply line and a supply of a first pulsed air stream with a pulse frequency f1 via a first air supply line to a combustion chamber. The method may further comprise supplying a second pulsed air stream via a second air supply line with a pulse frequency f2 to the combustion chamber, wherein f2 is preferably higher or lower than f1. The method may comprise the further steps of adjusting (controlling) f1 and f2 so that an average frequency f4=(f1+f2)/2 resonates with the combustion chamber. The average frequency may stay in the combustion chamber. A beat frequency f3 (of f1 and f2) may pass through the combustion chamber and may preferably resonate with a drying chamber. The method may contain further features according to the functional features being described with respect to the pulsed combustor assembly and/or the pulsed combustion drier above.

Another aspect of the invention is a use of the pulse combustor assembly of the pre-described kind and/or a use of the pulse combustion drier of the pre-described kind for dehydration and/or granulation of a wet feedstock, in particular a viscous feedstock such as a feedstock containing natural fibres. The pulsed combustor assembly and/or the pulsed combustion drier and/or the method for dehydration and/or granulation may be applied for dehydration (drying) and simultaneously producing granular products, for example from (pumpable) pastes, slurries and/or (smoothie-like) purées, in particular derived from (whole) fruits and/or vegetables (e.g. as used in the food and/or beverage industry sectors). Further applications may be other (paste-like) feedstock such as meat, fish and/or dairy products (e.g. including viscous polymers, minerals and/or chemicals).

Preferably, the pulsed combustion dryer does not comprise a Helmholtz resonator, in particular a resonating tube (at the outlet of the combustion chamber).

The enclosed FIGURE shows an embodiment and (further) aspects of the invention. The FIGURE shows a schematic of a dehydration and granulation apparatus.

The apparatus comprises a pulsed combustor assembly A for generating a (continuous) stream of high-temperature sonic pulses. Combustor assembly A is coupled to a shear atomizer B. The shear atomizer B finely divides the wet feedstock before being dehydrated on its way to an (integrated) spouted bed granulator C. The spouted bed granulator C produces and delivers the final product as, in particular powders, granules or melts. The pulsed combustor assembly A and shear atomizer B may require less than 10 milliseconds for removing more than 90% of the product's moisture. The balance may be removed in the spouted bed granulator C.

The combustor assembly A is "externally" pulsed using two motorised air interrupters 13 and 14, which are both connected to a common compressed air supply 15 via a first and a second air supply line 26, 27. The compressed air supply provides sufficient energy for generating a stream of (sharp) acoustic pulses (or shockwaves) when the air passes through the air interrupters 13 and 14 in the direction of a combustion chamber 16. In the combustion chamber 16, the air is utilised for combustion and optionally as excess air.

A fuel supply line 23 provides fuel to the combustion chamber 16. The fuel is ignited by an ignition source 24. An inlet 25 is provided for supplying feedstock to the apparatus. Via an outlet 22, humid air and gas emerges from the drying chamber 17. Inlet 21 provides the spouting air source. The granulated product may emerge from an outlet 20.

The interrupters 13 and 14 may comprise a (motorised) rotating disk, lobe or valve assembly where a ported or shaped element rotates in (close) proximity to a stationary element. Ports may periodically interact or align with one another, thereby releasing a burst of pulsed air into the combustion chamber 16. Rotating the (motorised) interrupters 13 and 14 at a high speed generates two distinct (high-pitch, siren-like) tones at frequencies f1 and f2 respectively, where frequencies f1 and f2 are directly proportional to the motor speeds of the interrupters 13 and 14. Combining the two frequencies f1 and f2 in the combustion chamber 16 produces a distinct third, low beat frequency at a beat frequency f3 corresponding to (or at least closely approximating) the difference between the frequencies f1 and f2. By simultaneously varying the speeds of air interrupters 13 and 14 with a constant speed difference, corresponding to f3, a band of frequencies may be generated, defined by f1 and f2 without affecting the beat frequency f3. This high band of frequencies may contain both odd and even harmonic components of frequencies f1 and f2, while the low (fundamental) frequency f3 remains effectively unchanged.

The high-frequency band (between 300 and 500 Hz), as defined by f1 and f2, is adjusted to resonate with the (small volume) combustion chamber 16 while the low-frequency component f3 (at least approximately 30 Hz) passes through the combustion chamber 16 to resonate with a (larger volume) drying chamber 17.

Continuous pulsed combustion in the combustion chamber 16 generates a stream of high-temperature exhaust gases which exit from chamber 16 at high velocity (above 100 m/s) via a nozzle 18. The mass and inertia of the high-temperature, oscillating exhaust gases form a conduit or waveguide on which both high and low-frequency acoustic shockwaves are super-imposed. This conduit may channel a broadband of harmonic frequencies generated inside the combustion chamber (as well as acoustic energy at screech frequencies), towards an impingement zone 19.

Energy from the high-frequency (e.g. 300 to 500 Hz) and (optionally) screech frequency components of the hot pulsed gas stream is utilised both to atomise and dehydrate wet feedstock passing through the shear atomizer B into the impingement zone 19, while the low beat frequency component of e.g. 10 to 30 Hz is "tuned" to resonate with the (large-volume) drying chamber 17. The (acoustic) pulses at the beat frequency f3, generated in the pulsed combustor assembly A are generally too low to excite low acoustic resonance in the cavities of the (small-volume) combustion chamber 16 and pass through both the combustion chamber 16 and the shear atomizer B to find resonance in the (larger volume) drying chamber 17 forming a free board area of the spouted bed granulator C. Therefore, combustion chamber 16 behaves like a low pass filter for the beat frequency f3.

The following example further illustrates the effects and functions of the apparatus (the values are not necessarily limiting). If f1 is 430 Hz and f2 is 450 Hz, the beat frequency f3 is 20 Hz. The combustion chamber may be tuned to the odd and even half wavelength integers corresponding to the average frequency of 440 Hz falling midway between 430 Hz and 450 Hz. The beat frequency of 20 Hz, however, falls outside this resonance band due to its long acoustic wavelength.

The harmonics of the average frequency originating from the two high-frequency (shortwave length) shockwaves are used to atomize liquid feedstock while the high temperature component driven by the combustion gases is used to dehydrate the feedstock droplets formed during atomisation. The (low-frequency, long wavelength) beat frequency f3 (derived from f1 and f2) is used to enhance dehydration in the downstream drying chamber 17.

The apparatus allows the generation of both high temperatures (600 to 800° C.) and high frequency (100 to 500 Hz) acoustic shockwaves for atomizing and partly dehydrating liquid feedstock. The atomization and partial dehydration may require less than 0.1 seconds depending on the thermal efficiency of the pulse combustor. High viscosity slurries (as for example in the fruit and vegetable industries) typically require higher acoustic energy and longer atomization times. According to the prior art, usually a "post-atomization" thermal energy and comparatively long retention times are required for total dehydration. According to the present invention, thermal drying is partly replaced by acoustic drying which greatly reduces energy and product retention times and improves product quality and taste.

In particular, the apparatus creates improved sonic conditions inside the drying chamber in order to enhance the removal of residual moisture from the atomized droplets (aerosols) at lower temperatures and shorter product retention times.

In the prior art, after product atomization and partial dehydration, most or all of the thermal and sonic energy is spent, leaving little or no acoustic energy for further dehydration inside the downstream drying chamber. The present apparatus, however, allows subjecting the aerosols in the drying chamber to (transverse) sonic waves, which may be tuned to resonate with the drying chamber cavity. These high energy pressure and partial vacuum pulses based on the low beat frequency f3 accelerate mass transfer (moisture evaporation), thereby allowing a reduction of both chamber temperature and product retention times.

Because the two frequencies f1 and f2 are provided, it is possible to have a low fundamental frequency (of 10 to 30 Hz) within the drying chamber which would not be possible with a single frequency provided to the combustion chamber.

In general, low-frequency acoustic waves have longer wavelengths which are more suited to resonate with the large volume drying chamber.

Moreover, even if low-frequency (long wavelength) pulses are ineffective when used to atomize feedstock (slurries) they are very efficient in enhancing heat and mass transfer inside the drying chamber 17. Because of the higher efficiency, the drying chamber may be smaller (compared with the prior art). The beat frequency f3 may be varied or tuned to resonate with the drying chamber's physical dimensions (at different temperatures and/or gas density conditions). The exact values of f1 and f2 are (in this regard) not relevant, as long as the difference between f1 and f2 is suitably adjusted. This means, acoustic resonance in a drying chamber can be maintained within a band of any two frequencies.

A further example may illustrate the advantages of apparatus (the values are not necessarily limiting). With a hypothetical high combustion chamber frequency band defined by f1=350 Hz and f2=330 Hz, the beat frequency or drying chamber frequency f3 will be 20 Hz. Likewise, if f1=450 Hz and f2=430 Hz, a beat frequency f3 is also 20 Hz. Drying chamber efficiency could therefore be optimized "tuning" the beat frequencies of any "band" of two frequencies, thereby reducing time and thermal energy required for post-atomization dehydration. According to the prior art, optimization of both the combustion chamber and the drying process (via resonance) is not possible with a single frequency provided to the combustion chamber.

REFERENCE NUMERALS

A Pulse combustor assembly
B Shear atomizer
C Spouted bed granulator
13 First air interrupter
14 Second air interrupter
15 Compressed air supply
16 Combustion chamber
17 Drying chamber
18 Nozzle
19 Impingement zone
20 Outlet for granulated products
21 Inlet for spouting air
22 Outlet for humid air and gas
23 Fuel supply line
24 Ignition
25 Inlet for feedstock
26 First air supply line
27 Second air supply line

The invention claimed is:

1. A pulsed combustor assembly for dehydration or granulation of a wet feedstock, in particular a viscous feedstock containing at least one of natural fibres, sugars, vegetable starches, or combinations thereof comprising a combustion chamber, at least one fuel supply line, at least one air supply line, and at least one pulsed air generator, wherein the pulsed air generator is connected to the air supply line for generating at least a first pulsed air stream with a pulse frequency f1 entering the combustion chamber;

a second air supply line and a second pulsed air generator being connected to the second air supply line and configured to generate a second pulsed air stream with a pulse frequency f2 entering the combustion chamber, wherein f2 is higher or lower than f1;

a control means for adjusting the frequency f1 within a predetermined range and for adjusting the frequency f2 within a predetermined range;

wherein the control means is configured to adjust the frequencies f1 and f2 to generate a beat frequency f3 within the combustion chamber; and wherein the control means is configured to adjust the frequencies f1 and f2 such that the combustion chamber functions as a low pass filter filtering the average frequency f4=(f1+f2)/2, and preferably odd and even harmonics thereof, wherein the beat frequency f3 of the frequencies f1 and f2 passes the combustion chamber.

2. The pulsed combustor assembly of claim 1, wherein at least one of the first or second pulsed air generator comprises a motorized, air interrupter, comprising a rotating disc, lobe or valve assembly, and wherein the first air supply line and the second air supply line are connected to a common compressed air supply line.

3. The pulsed combustor assembly of claim 1, wherein the control means is configured to simultaneously vary the frequencies f1 and f2 within a pre-determined frequency range, wherein a difference f1−f2 is preferably at least substantially constant for generating an at least substantially constant beat frequency f3.

4. The pulsed combustor assembly of claim 1, wherein 4 at least one of f1 or f2 is more than 100 Hz and less than 600 Hz and an average frequency f4=(f1+f2)/2 is more than 200 Hz and less than 500 Hz and the beat frequency f3 is more than 10 Hz and less than 30 Hz.

5. The pulsed combustor assembly of claim 1, wherein the frequencies f1 and f2 are adjusted or adjustable, in particular by the control means such that the fundamental frequency and odd and even harmonics of an average frequency f4=(f1+f2)/2 resonate with the combustion chamber.

6. A pulsed combustion dryer comprising a pulsed combustor assembly of claim 1.

7. The pulsed combustion dryer of claim 6, comprising an atomizer, in particular shear atomizer or a drying chamber, wherein a volume of the drying chamber is preferably larger than a volume of the combustion chamber, further preferably at least 50 times, even further preferably at least 100 times as large, and a granulator, in particular spouted bed granulator.

8. The pulsed combustion dryer of claim 6 wherein the beat frequency f3 resonates with the drying chamber.

9. A method for dehydration or granulation of a wet feedstock, in particular a viscous feedstock containing at least one of natural fibres, sugars, vegetable starches, or combinations thereof, preferably utilizing the pulsed combustor assembly of claim 1, or the pulsed combustion dryer of claim 6 or both, comprising a supply of fuel via a fuel supply line and a supply of a first pulsed air stream with a pulse frequency f1 via a first air supply line to a combustion chamber, wherein the method further comprises:

supplying a second pulsed air stream via a second air supply line with a frequency f2 to the combustion chamber, wherein f2 is higher or lower than f1, adjusting an average frequency f4=(f1+f2)/2 in the combustion chamber so that f4, and optionally odd and even harmonics thereof, resonate within the combustion chamber, and adjusting a beat frequency f3 of f1 and f2 so that it passes through the combustion chamber.

10. The method of claim 9, wherein the beat frequency resonates within the drying chamber.

11. A use of the pulsed combustor assembly of claim 1 or the pulsed combustion dryer of claim 6, for dehydration or granulation of a wet feedstock, in particular a viscous feedstock containing natural fibres.

* * * * *